US008784131B2

(12) United States Patent
Jeon et al.

(10) Patent No.: US 8,784,131 B2
(45) Date of Patent: Jul. 22, 2014

(54) WIRE CONNECTING DEVICE FOR HYBRID VEHICLE

(75) Inventors: Wooyong Jeon, Seoul (KR); Jinhwan Jung, Gyeonggi-do (KR); Junghong Joo, Gyeonggi-do (KR); Hyeoundong Lee, Gyeonggi-do (KR); Okin Bin, Incheon (KR); Taesuk Kwon, Gyeonggi-do (KR); Junha Hwang, Gyeonggi-do (KR); Youngseop Park, Gyeonggi-do (KR)

(73) Assignees: Hyundai Motor Company, Seoul (KR); Hyundai Mobis Co., Ltd., Seoul (KR); Kyungshin Corp., Incheon (KR)

( * ) Notice: Subject to any disclaimer, the term of this patent is extended or adjusted under 35 U.S.C. 154(b) by 283 days.

(21) Appl. No.: 13/295,412

(22) Filed: Nov. 14, 2011

(65) Prior Publication Data

US 2012/0329344 A1 Dec. 27, 2012

(30) Foreign Application Priority Data

Jun. 24, 2011 (KR) ..... 10-2011-0061475

(51) Int. Cl.
*H01R 13/60* (2006.01)
*H01R 13/518* (2006.01)
*H01R 25/14* (2006.01)

(52) U.S. Cl.
CPC ..... *H01R 13/518* (2013.01); *H01R 25/14* (2013.01); *Y10S 439/954* (2013.01)
USPC ..... 439/540.1; 439/212; 439/954

(58) Field of Classification Search
CPC ..... H01R 13/518; H01R 23/025; H01R 4/30; H01R 25/14
USPC ..... 439/34, 212, 213, 540.1, 639, 884, 902, 439/76.2, 949
See application file for complete search history.

(56) References Cited

U.S. PATENT DOCUMENTS

| | | | | |
|---|---|---|---|---|
| 6,855,007 | B2 * | 2/2005 | Irish et al. | 439/614 |
| 6,916,199 | B2 * | 7/2005 | Follingstad | 439/534 |
| 7,025,595 | B1 * | 4/2006 | Chan et al. | 439/6 |

FOREIGN PATENT DOCUMENTS

| | | | |
|---|---|---|---|
| JP | 2004056924 | A | 2/2004 |
| JP | 2005-093166 | A | 4/2005 |
| JP | 2008245461 | A | 10/2008 |
| KR | 10-2004-0000729 | | 1/2004 |
| KR | 10-2004-0108061 | | 12/2004 |
| KR | 10-2007-0051361 | A | 5/2007 |
| KR | 10-2011-0068528 | A | 6/2011 |

* cited by examiner

*Primary Examiner* — Khiem Nguyen
(74) *Attorney, Agent, or Firm* — Edwards Wildman Palmer LLP; Peter F. Corless

(57) ABSTRACT

Disclosed is a wire connecting device for a vehicle, preferably a hybrid vehicle, including six individual bus bars for connecting two 3-phase AC sub-devices to a main device, in which the bus bars are divided in to a first unit terminal unit and a second unit terminal unit each composed of a U-pole bus bar, a V-pole bus bar, and a W-pole bus bar, predetermined ends of the U-pole bus bar, the V-pole bus bar, and the W-pole bus bar of the first unit terminal unit bend to a side, and predetermined ends of the U-pole bus bar, the V-pole bus bar, and the W-pole bus bar of the second unit terminal unit bend to the other side.

17 Claims, 5 Drawing Sheets

WIRE CONNECTING DEVICE FOR HYBRID VEHICLE

CROSS-REFERENCE TO RELATED APPLICATIONS

The present application claims priority to Korean Patent Application Number 10-2011-0061475 filed Jun. 24, 2011, the entire contents of which application is incorporated herein for all purposes by this reference.

BACKGROUND OF THE INVENTION

1. Field of the Invention

The present invention relates to a wire connecting device for a hybrid vehicle, and more particularly, to a wire connecting device for a hybrid vehicle that can prevent interference when an external device is connected to unit bus bars by inclining predetermined sides of the unit bus bars composed of a U-pole bus bar, a V-pole bus bar, and a W-pole bus bar in opposite directions such that the distance between the unit bus bars becomes the maximum.

2. Description of Related Art

Recently, hybrid electric vehicles, which are equipped with both an internal combustion engine and a battery powered motor for semi-electric vehicle operation, or of which the fuel consumption and the exhaust amount of toxic gases are remarkably reduced in comparison to ordinary vehicles by remarkably reducing the weight of the car body to minimize the air resistance, have been developed. Hybrid electric vehicles require a high voltage/high current in comparison to the standard fuel consumption vehicles. Therefore, an electric device for receiving power from outside of the hybrid electric vehicles and efficiently distributing the power to the inside would be beneficial.

Accordingly, a connector disposed therein is designed to be disposed at an inverter that connects a 3-phase AC motor for an electric vehicle. In particular, the connector includes three bus bar terminals corresponding to three poles circuit (U-pole, V-pole, and W-pole), wires-with-terminals coupling the bus bar terminals with bolts, housings made of insulating resin and receiving the terminals, and shield shells made of conductive metal and covering the outsides of the housings. The technical configuration is one of the related art for helping understanding the present invention, but does not mean that the related art is widely known in the field of the present invention.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

In particular, the existing connector assemblies of existing hybrid vehicles, problematically, have a plurality of bus bars are arranged in parallel at a predetermined distance from each other. Because of this, interference is caused by adjacent bus bars when external devices are connected to the bus bars, and assembling performance is considerably deteriorated. Therefore, the problem should be addressed.

The present invention has been made in an effort to provide a wire connecting device for a hybrid vehicle that prevents interference when an external device is connected to unit bus bars by inclining the same sides of the unit bus bars composed of a U-pole bus bar, a V-pole bus bar, and a W-pole bus bar in the opposite directions such that the distance between the unit bus bars becomes the maximum. The present invention has been made in an effort to provide a wire connecting device for a hybrid vehicle that can prevent a short circuit by arranging predetermined sides of a U-pole bus bar, a V-pole bus bar, and a W-pole bus bar constituting a unit bus bar in parallel.

An exemplary embodiment of the present invention provides a wire connecting device for a hybrid vehicle, including: bus bars corresponding to a multi-phase for each of a plurality of multi-phase AC sub-devices to connect sub-devices to a main device, in which the bus bars for the sub-devices are spaced apart from each other for each of the sub-devices and predetermined ends of the bus bars are formablely bent and spaced apart from each other for each of the sub-devices.

The multi-phase AC sub-devices may be two 3-phase AC sub-devices and the bus bars are divided into a first unit terminal unit and a second unit terminal unit each composed of a U-pole bus bar, a V-pole bus bar, and a W-pole bus bar, corresponding to the two sub-devices, predetermined ends of the U-pole bus bar, the V-pole bus bar, and the W-pole bus bar of the first unit terminal unit may bend to a side, and predetermined ends of the U-pole bus bar, the V-pole bus bar, and the W-pole bus bar of the second unit terminal unit may bend to the other side. The predetermined ends of the U-pole bus bar, the V-pole bus bar, and the W-pole bus bar of the first unit terminal unit and the predetermined ends of the U-pole bus bar, the V-pole bus bar, and the W-pole bus bar of the second unit terminal unit may extend at an angle in the opposite directions to be linearly symmetric.

The predetermined ends of the U-pole bus bar, the V-pole bus bar, and the W-pole bus bar of the first unit terminal unit may be arrange in parallel with each other. Additionally, the predetermined ends of the U-pole bus bar, the V-pole bus bar, and the W-pole bus bar of the second unit terminal unit may be arrange in parallel with each other. The predetermined ends of the U-pole bus bar, the V-pole bus bar, and the W-pole bus bar of the first unit terminal unit may bend forward or backward with respect to the axial direction, and the predetermined ends of the U-pole bus bar, the V-pole bus bar, and the W-pole bus bar of the second unit terminal unit may bend forward or backward with respect to the axial direction.

According to the exemplary embodiments of the present invention, the wire connecting device for a hybrid vehicle prevents interference when an external device is connected to unit bus bars by inclining the same sides of the unit bus bars composed of a U-pole bus bar, a V-pole bus bar, and a W-pole bus bar in the opposite directions such that the distance between the unit bus bars become the maximum. Additionally, it is possible to prevent a short circuit by arranging predetermined sides of a U-pole bus bar, a V-pole bus bar, and a W-pole bus bar constituting a unit bus bar in parallel.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
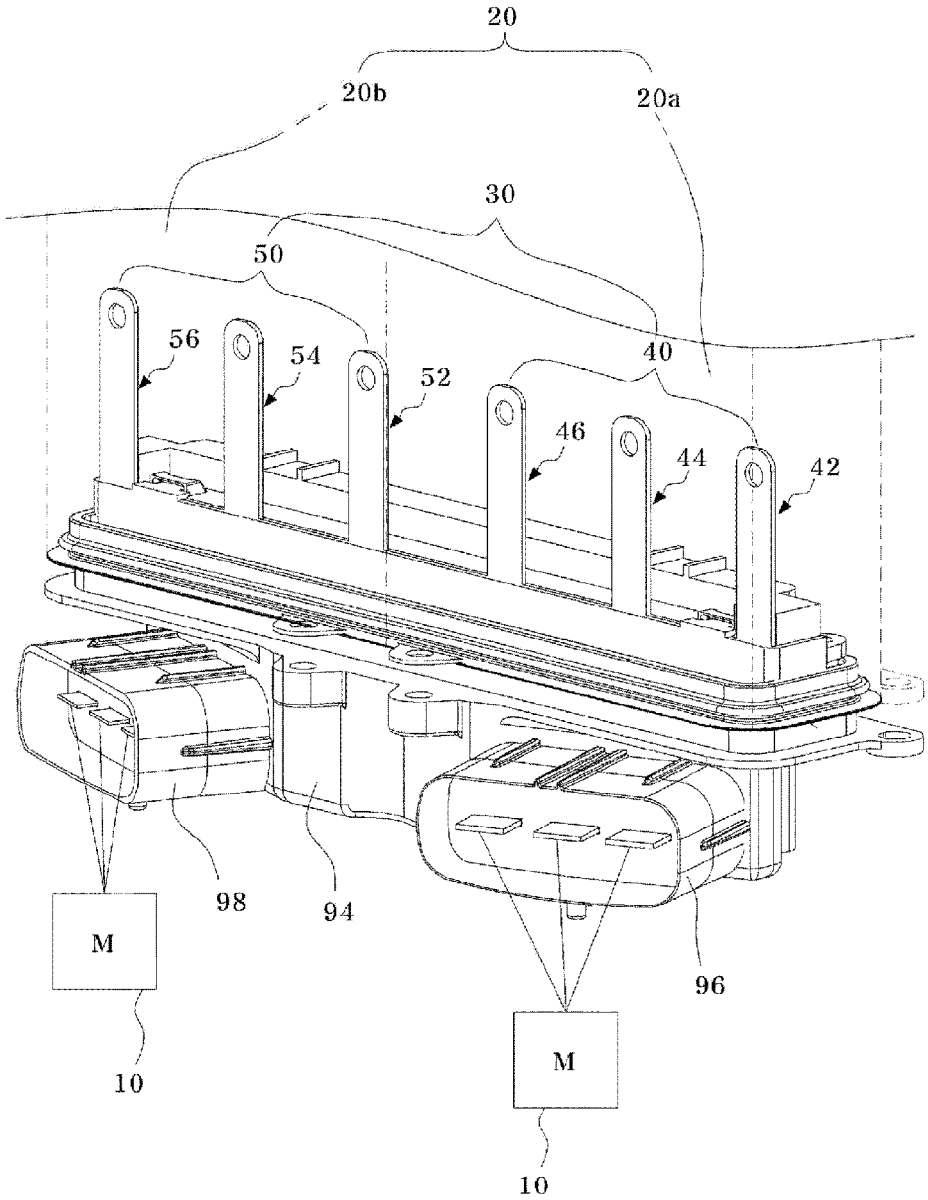
FIG. 1 is a perspective view of a wire connecting device for a hybrid vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Hereinafter, exemplary embodiments of a wire connecting device for a hybrid vehicle of the present invention will be described in detail with reference to the accompanying drawings. The thickness of the lines and the size of components shown in the drawings may be exaggerated herein for clear and convenient description. The following terminologies are defined in consideration of the functions in the present invention and may be construed in different ways by the intention of users and operators. Therefore, these terminologies should be defined on the basis of the description throughout the specification.

Figure 2:
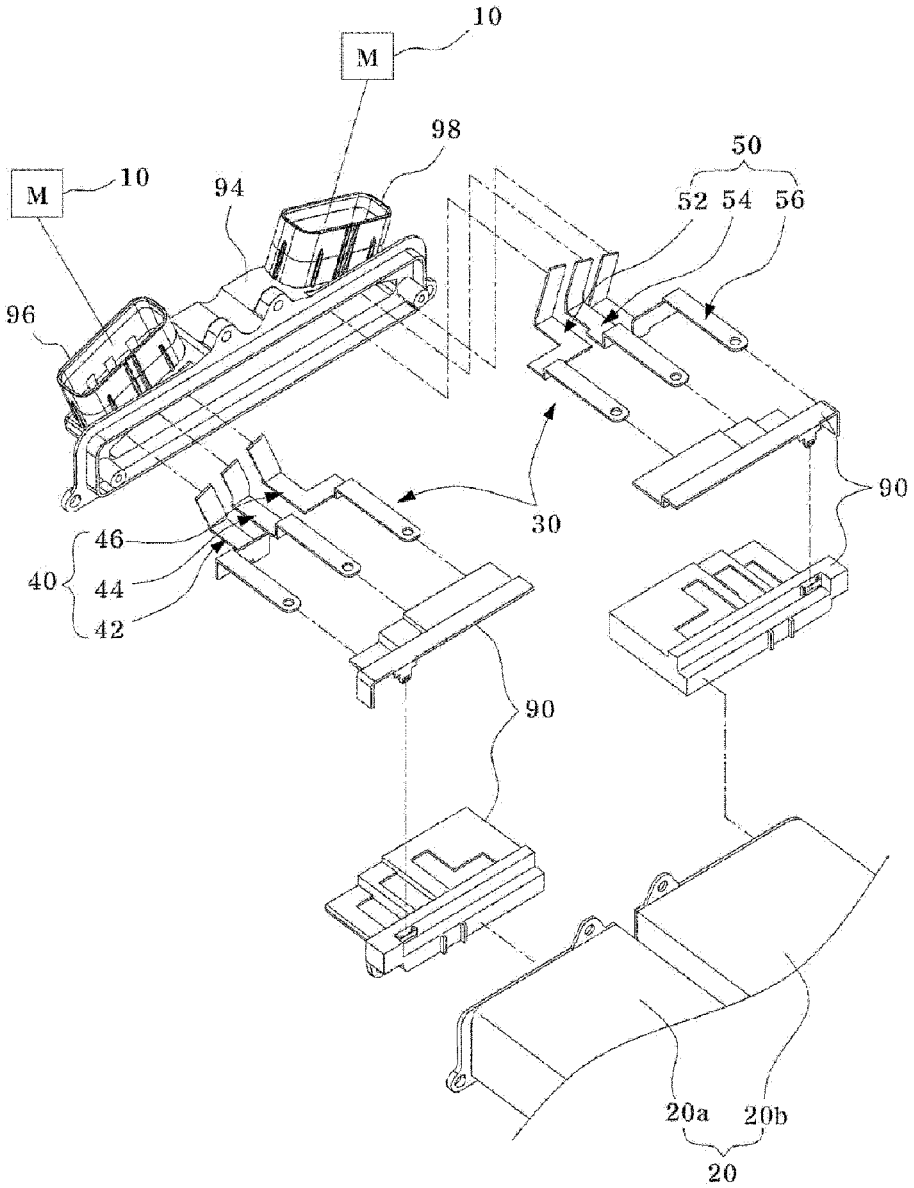
FIG. 2 is an exploded perspective view of a wire connecting device for a hybrid vehicle according to an exemplary embodiment of the present invention.

Referring to FIGS. 1 and 2, a wire connecting device for a hybrid vehicle according to the exemplary embodiment of the present invention includes six individual bus bars 30 for connecting two 3-phase AC sub-devices 10 to a main device 20. A plurality of sub-devices 10 may be provided, which are each for providing multi-phase alternating current, but it is assumed that two 3-phase AC sub-devices are provided, for convenience purposes. In particular, bus bar 30 is divided into unit terminal units 40 and 50 composed of a U-pole bus bar 42 and 52, a V-pole bus bar 44 and 54, and a W-pole bus bar 46 and 56. That is, unit terminal units 40 and 50 has U-pole bus bars 43 and 52, V-pole bus bars 44 and 54, and W-pole bus bars 46 and 56, respectively.

In this configuration, since two sub-devices 10 are provided, as shown in FIG. 1, two unit terminals 40 and 50 are provided. In other words, unit terminal units 40 and 50 are first unit terminal unit 40 and second unit terminal unit 50. Obviously, the number of unit terminal units 40 and 50 is not limited thereto. For example, sub-devices 10 may be two motors, that is, an alternator and a start motor and the main device 20 may be an inverter. Therefore, first unit terminal unit 40 is composed of U1-pole bus bar 42, V1-pole bus bar 44, and W1-pole bus bar 46, which are connected with any one of two sub-devices 10. Similarly, second unit terminal unit 50 is composed of U2-pole bus bar 52, V2-pole bus bar 54, and W2-pole bus bar 56, which are connected with the other sub-device 10.

Predetermined sides of U1-pole bus bar 42, V1-pole bus bar 44, and W1-pole bus bar 46, and U2-pole bus bar 52, V2-pole bus bar 54, and W2-pole bus bar 56 are connected with corresponding sub-device 10 and the other sides are connected to main device 20. U1-pole bus bar 42, V1-pole bus bar 44, and W1-pole bus bar 46, and U2-pole bus bar 52, V2-pole bus bar 54, and W2-pole bus bar 56 may be arranged such that the gaps can be decreased as much as possible within a available range to reduce the volume of main device 20 and the gap between the pair of sub-devices 10.

The 'available range' means that U1-pole bus bar 42, V1-pole bus bar 44, and W1-pole bus bar 46, and U2-pole bus bar 52, V2-pole bus bar 54, and W2-pole bus bar 56 are arranged in the predetermined volume of main device 20. Therefore, U1-pole bus bar 42, V1-pole bus bar 44, and W1-pole bus bar 46, and U2-pole bus bar 52, V2-pole bus bar 54, and W2-pole bus bar 56 are arranged at a distance from each other, not overlapping each other, in a plane, in main device 20. This is for preventing partial surface contact of U1-pole bus bar 42, V1-pole bus bar 44, and W1-pole bus bar 46, and U2-pole bus bar 52, V2-pole bus bar 54, and W2-pole bus bar 56, when an external shock is transmitted. In particular, for first unit terminal unit 40, U1-pole bus bar 42, V1-pole bus bar 44, and W1-pole bus bar 46 are sequentially arranged from a side to the other side.

Similarly, for second unit terminal unit 50, U2-pole bus bar 52, V2-pole bus bar 54, and W2-pole bus bar 56 are sequentially arranged from a side to the other side. In this configuration, first unit terminal unit 40 and second unit terminal unit 50 are arranged adjacent to each other while W1-pole bus bar 46 and U2-pole bus bar 52 are arranged adjacent to each other. In other words, U1-pole bus bar 42 and U2-pole bus bar 52, V1-pole bus bar 44 and V2-pole bus bar 54, and W1-pole bus bar 46 and W2-pole bus bar 56, which have the same poles, are arranged so that they are not adjacent to each other. Therefore, U1-pole bus bar 42 and U2-pole bus bar 52, V1-pole bus bar 44 and V2-pole bus bar 54, and W1-pole bus bar 46 and W2-pole bus bar 56, which have the same poles, in the first unit terminal unit 40 and the second unit terminal unit 50, are not in contact with each other, thereby preventing a short circuit.

Meanwhile, U1-pole bus bar 42, V1-pole bus bar 44, and W1-pole bus bar 46 of first unit terminal unit 40 may be formed at a predetermined distance as large as possible within an available range. U2-pole bus bar 52, V2-pole bus bar 54, and W2-pole bus bar 56 of second unit terminal unit 50 may be formed at a predetermined distance as large as possible within an available range.

Figure 3:
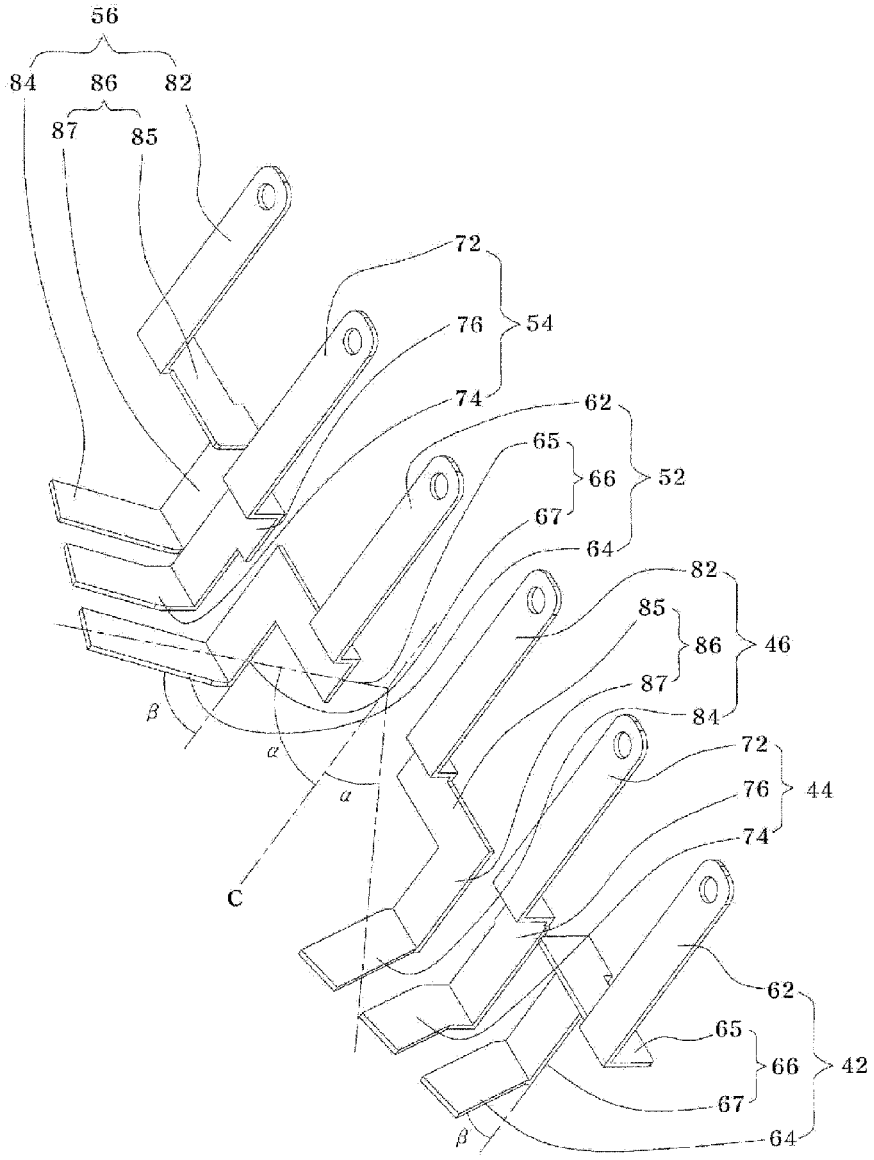
FIG. 3 is an enlarged perspective view showing the arrangement status of bus bars according to an exemplary embodiment of the present invention.

In detail, as shown in FIG. 3, U1-pole bus bar 42 and U2-pole bus bar 52 each include a U-main terminal unit 62, a U-sub-terminal unit 64, and a U-connection terminal unit 66. U-main terminal unit 62 is the other side of U1-pole bus bar 42 and U2-pole bus bar 52 and connected to main device 20 while U-sub-terminal unit 64 is the predetermined side of U1-pole bus bar 42 and U2-pole bus bar 52 and connected to sub-device 10. In this configuration, U-main terminal unit 62 and U-sub-terminal unit 64 may be formed straight to be connected to main device 20 or sub-device 10. U-main terminal unit 62 and U-sub-terminal unit 64 may extend curvedly from U-connection terminal unit 66 or extend straight from U-connection terminal unit 66, in accordance with the arrangement of main device 20 or sub-device 10 where they are connected.

U-connection terminal unit 66 connects U-main terminal unit 62 with U-sub-terminal unit 64. Obviously, U-main terminal unit 62, a U-sub-terminal unit 64, and a U-connection terminal unit 66 are preferably integrally formed, and have electric conductivity. In particular, U-connection terminal unit 66 has a U-spacing terminal unit 65 and a U-extending terminal unit 67. U-spacing terminal unit 65 extends straight toward a V-main terminal unit 72, which is described later, of c V1-pole bus bar 44 or V2-pole bus bar 54 from U-main terminal unit 62 in order to space U-main terminal unit 62 at a predetermined distance in a plane from V-main terminal unit 72 of adjacent V1-pole bus bar 44 or V2-pole bus bar 54. As U-spacing terminal unit 65 is spaced at a predetermined distance from a V-connection terminal unit 76, which is described later, of V1-pole bus bar 44 or V2-pole bus bar 54, U-main terminal unit 62 is sufficiently spaced from V-main terminal unit 72 of adjacent V1-pole bus bar 44 or V2-pole bus bar 54. Obviously, U-spacing terminal unit 65 may be changed in various shapes, but is preferably formed linearly.

U-extending terminal unit 67 is connected to U-sub-terminal unit 64, bending toward U-sub-terminal unit 64 from an end of U-spacing terminal unit 65. Obviously, it is preferable that U-extending terminal unit 67 is formed linearly. Therefore, U-connection terminal unit 66 bends in a plane.

V1-pole bus bar 44 and V2-pole bus bar 54 each include V-main terminal unit 72, V-sub device unit 74, and connection terminal unit 76. V-main terminal unit 72 is the other side of V1-pole bus bar 44 and V2-pole bus bar 54 and connected to main device 20 while V-sub-terminal unit 74 is the predetermined side of V1-pole bus bar 44 and V2-pole bus bar 54 and connected to sub-device 10. In this configuration, V-main terminal unit 72 and V-sub-terminal unit 74 may be formed linearly to be connected to main device 20 or sub-device 10. V-main terminal unit 72 and V-sub-terminal unit 74 may extend curvedly from V-connection terminal unit 76 or extend linearly from V-connection terminal unit 76, in accordance with the arrangement of main device 20 or sub-device 10 where they are connected. V-connection terminal unit 76 connects V-main terminal unit 72 with V-sub device unit 74 and is preferably formed linearly. Obviously, V-main terminal unit 72, V-sub-terminal unit 74, and V-connection terminal unit 76 are preferably integrally formed, and have electric conductivity.

Meanwhile, W1-pole bus bar 46 and W2-pole bus bar 56 each include a W-main terminal unit 82, a W-sub device unit 84, and a W-connection terminal unit 86. W-main terminal unit 82 is the other side of W1-pole bus bar 46 and W2-pole bus bar 56 and connected to main device 20 while W-sub-terminal unit 84 is the predetermined side of W1-pole bus bar 46 and W2-pole bus bar 56 and connected to sub-device 10. In this configuration, W-main terminal unit 82 and W-sub-terminal unit 84 may be formed linearly to be connected to main device 20 or sub-device 10. W-main terminal unit 82 and W-sub-terminal unit 84 may extend curvedly from W-connection terminal unit 86 or extend linearly from W-connection terminal unit 86, in accordance with the arrangement of main device 20 or sub-device 10 where they are connected.

W-connection terminal unit 86 connects W-main terminal unit 82 with W-sub-terminal unit 84. Obviously, W-main terminal unit 82, W-sub-terminal unit 84, and W-connection terminal unit 86 are preferably integrally formed, and have electric conductivity. In particular, W-connection terminal unit 86, as shown in FIG. 3, includes a W-spacing terminal unit 85 and a W-extending terminal unit 87. W-spacing terminal unit 85 extends linearly toward a V-main terminal unit 72 of V1-pole bus bar 44 or V2-pole bus bar 54 from W-main terminal unit 82 in order to space W-main terminal unit 82 at a predetermined distance in a plane from V-main terminal unit 72 of adjacent V1-pole bus bar 44 or V2-pole bus bar 54. As W-spacing terminal unit 85 is spaced at a predetermined distance from a V-connection terminal unit 76 of V1-pole bus bar 44 or V2-pole bus bar 54, W-main terminal unit 82 is sufficiently spaced from V-main terminal unit 72 of adjacent V1-pole bus bar 44 or V2-pole bus bar 54. Obviously, W-spacing terminal unit 85 may be changed in various shapes, but is preferably formed linearly. W-extending terminal unit 87 is connected to W-sub-terminal unit 84, bending toward W-sub-terminal unit 84 from an end of W-spacing terminal unit 85. Again, obviously it is preferable that W-extending terminal unit 87 is formed linearly. Therefore, W-connection terminal unit 86 bends in a plane.

Figure 4:
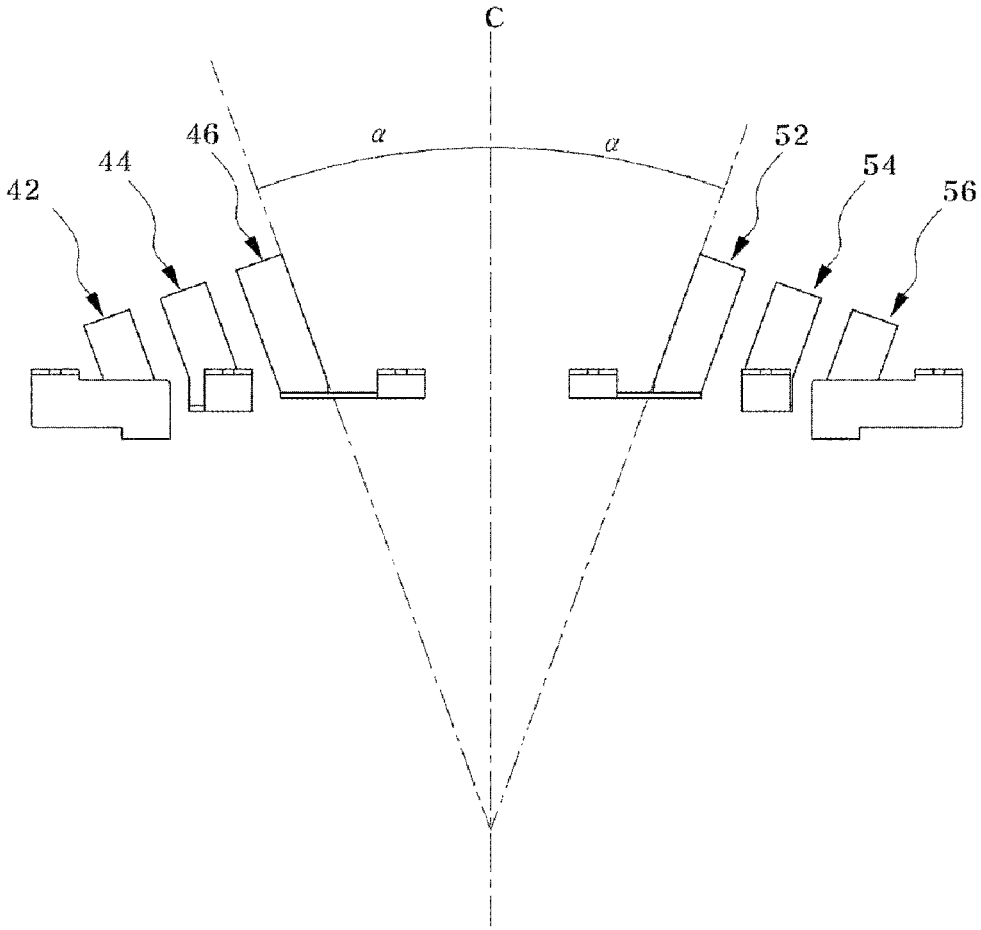
FIG. 4 is a plan view showing the arrangement status of bus bars according to an exemplary embodiment of the present invention.

As shown in FIG. 3, U-connection terminal unit 66 and W-connection terminal unit 86 of first unit terminal unit 40 are symmetrically formed while U-connection terminal unit 66 and W-connection terminal unit 86 of second unit terminal unit 50 are symmetrically formed. As shown in FIGS. 3 and 4, U-sub-terminal unit 64 of U1-pole bus bar 42, V V-sub-terminal unit 74 of V1-pole bus bar 4, and W-sub-terminal unit 84 of W1-pole bus bar 46, in first unit terminal unit 40, are all formablely bent in the one direction in the same way with respect to the longitudinal direction of a cap 94. U-sub-terminal unit 64 of U2-pole bus bar 52, V V-sub-terminal unit 74 of V2-pole bus bar 54, and W-sub-terminal unit 84 of W2-pole bus bar 56, in second unit terminal unit 40, are all formablely bent in the other direction in the same way with respect to the longitudinal direction of cap 94. This configuration prevents interference with a connector (not shown) of another motor 10 connected to second unit terminal unit 50 through a second connecting member 98, when the connector of any one motor 10 (not shown) is connected to first unit terminal unit 40 through a first connecting member 96. That is, the connector of any one motor 10 may be disposed as far as possible from the connector of the other motor 10 at the same side of cap 94. In other words, predetermined ends of U1-pole bus bar 42, V1-pole bus bar 44, and W1-pole bus bar 46 of first unit terminal unit 40 bend to a side.

In this configuration, predetermined ends of U1-pole bus bar 42, V1-pole bus bar 44, and W1-pole bus bar 46 mean U-sub-terminal unit 64 of U1-pole bus bar 42, V-sub-terminal unit 74 of V1-pole bus bar 44, and W-sub-terminal unit 84 of W1-pole bus bar 46, respectively. The direction in which U1-pole bus bar 42, V1-pole bus bar 44, and W1-pole bus bar 46 bend means the direction to an edge of cap 94. The same ends of U2-pole bus bar 52, V2-pole bus bar 54, and W2-pole bus bar 56 of second unit terminal unit 50 bend to the other sides.

In this configuration, predetermined ends of U2-pole bus bar 52, V2-pole bus bar 54, and W2-pole bus bar 56 means U-sub-terminal unit 64 of U2-pole bus bar 52, V-sub-terminal unit 74 of V2-pole bus bar 54, and W-sub-terminal unit 84 of W2-pole bus bar 56, respectively. The direction in which U2-pole bus bar 52, V2-pole bus bar 54, and W2-pole bus bar 56 bend means the direction to the other edge of cap 94. In particular, the other edge of cap 94 means the side right opposite to one edge.

As shown in FIG. 3, U-sub-terminal unit 64, V-sub-terminal unit 74, and W-sub-terminal unit 84 of first unit terminal unit 40 are disposed gradually counterclockwise away from the center line C at a predetermined angle α to the outside. In particular, U-sub-terminal unit 64 inclines outward at a predetermined angle α with respect to the axial direction of U-extending terminal unit 67, V-sub-terminal unit 74 inclines outward at a predetermined angle α with respect to the axial direction of V-connection terminal unit 76, and W-sub-terminal unit 84 inclines outward at a predetermined angle α with respect to the axial direction of W-extending terminal unit 87.

Similarly, as shown in FIG. 3, U-sub-terminal unit 64, V-sub-terminal unit 74, and W-sub-terminal unit 84 of second unit terminal unit 50 are disposed gradually clockwise away from the center line C at a predetermined angle α to the outside. In particular, U-sub-terminal unit 64 inclines outward at a predetermined angle α with respect to the axial direction of U-extending terminal unit 67, V-sub-terminal unit 74 inclines outward at a predetermined angle α with respect to the axial direction of V-connection terminal unit 76, and W-sub-terminal unit 84 inclines outward at a predetermined angle α with respect to the axial direction of W-extending terminal unit 87. That is, U-sub-terminal unit 64, V-sub-terminal unit 74, and W-sub-terminal unit 84, which are the same ends of U1-pole bus bar 42, V1-pole bus bar 44, and W1-pole bus bar 46 of first unit terminal unit 40, extend at an angle in the opposite direction to be linearly symmetric to U-sub-terminal unit 64, V-sub-terminal unit 74, and W-sub-terminal unit 84 which are the same ends of U2-pole bus bar 52, V2-pole bus bar 54, and W2-pole bus bar 56 of second unit terminal unit 50.

Meanwhile, as U-sub-terminal unit 64, V-sub-terminal unit 74, and W-sub-terminal unit 84 of first unit terminal unit 40 incline at the same angle, such that they are arranged in parallel with each other. Therefore, U-sub-terminal unit 64, V-sub-terminal unit 74, and W-sub-terminal unit 84 are kept away from each other such that they are not in contact with each other. Similarly, as U-sub-terminal unit 64, V-sub-terminal unit 74, and W-sub-terminal unit 84 of second unit terminal unit 50 incline at the same angle, such that they are arranged in parallel with each other.

As shown in FIG. 3, U-sub-terminal unit 64, V-sub-terminal unit 74, and W-sub-terminal unit 84, which are ends of U1-pole bus bar 42, V1-pole bus bar 44, and W1-pole bus bar 46 of first unit terminal unit 40, are bent forward or backward at a predetermined angle β with respect to the axial directions of corresponding U-extending terminal unit 67, V-connection terminal unit 76, and W-extending terminal unit 87, such that a spatial limit can be decreased when they are connected with sub-devices 10. For the convenience, U-sub-terminal unit 64, V-sub-terminal unit 74, and W-sub-terminal unit 84 are shown as bending forward.

Similarly, as shown in FIG. 3, U-sub-terminal unit 64, V-sub-terminal unit 74, and W-sub-terminal unit 84, which are ends of U2-pole bus bar 52, V2-pole bus bar 54, and W2-pole bus bar 56 first unit terminal unit 50, are bent forward or backward at a predetermined angle β with respect to the axial directions of corresponding U-extending terminal unit 67, V-connection terminal unit 76, and W-extending terminal unit 87, such that a spatial limitation can be decreased when they are connected with sub-devices 10. For convenience and understanding, U-sub-terminal unit 64, V-sub-terminal unit 74, and W-sub-terminal unit 84 are shown as bending forward.

The same number of main devices 20 as unit terminal units 40 and 50 are provided to be one-to-one mounted on unit terminal units 40 and 50. That is, as shown in FIG. 1, first unit terminal unit 40 is connected to a first main device 20*a* and second unit terminal unit 50 is connected to a second main device 20*b*. In more detail, U1-pole bus bar 42, V1-pole bus bar 44, and W1-pole bus bar 46 are connected to first main device 20*a*. Similarly, U2-pole bus bar 52, V2-pole bus bar 54, and W2-pole bus bar 56 are connected to second main device 20*b*. Therefore, since main device 20 is divided into first main device 20*a* where first unit terminal unit 40 is connected and second main device 20*b* where second unit terminal unit 50 is connected, first main device 20*a* or second main device 20*b* can be separately replaced, such that the maintenance cost of main device 20 is reduced.

Meanwhile, U1-pole bus bar 42, V1-pole bus bar 44, and W1-pole bus bar 46 of first unit terminal unit 40 and U2-pole bus bar 52, V2-pole bus bar 54, and W2-pole bus bar 56 of second unit terminal unit 50 may be fixed with predetermined sides spaced apart from each other, at the outside of main device 20.

Cap 94 is detachably coupled to main device 20 and fixes predetermined sides of U1-pole bus bar 42, V1-pole bus bar 44, W1-pole bus bar 46, U2-pole bus bar 52, V2-pole bus bar 54, and W2-pole bus bar 56. In more detail, cap 94 fixes U-sub-terminal unit 64 of U1-pole bus bar 42 and U2-pole bus bar 52, fixes V-sub-terminal unit 74 of V1-pole bus bar 44 and V2-pole bus bar 54, and fixes W-sub-terminal unit 84 of W1-pole bus bar 46 and W2-pole bus bar 56.

Cap 94 may be formed in various shapes, may be an integral single unit, or may be composed of a plurality of separate parts. For convenience and understanding, cap 94 is implemented as a single unit, and spaces and fixes predetermined sides of U1-pole bus bar 42, V1-pole bus bar 44, and W1-pole bus bar 46, and U2-pole bus bar 52, V2-pole bus bar 54, and W2-pole bus bar 56 of second unit terminal unit 50. In particular, gap 94 prevents unexpected separation or shaking of first main device 20*a* and second main device 20*b* by allowing first main device 20*a* and second main device 20*b* to be separated. Obviously, cap 94 may be formed or manufactured in various shapes. Cap 94 has first connecting member 96 where U-sub-terminal unit 64 of U1-pole bus bar 42, V-sub-terminal unit 74 of V1-pole bus bar 44, and W-sub-terminal unit 84 of W1-pole bus bar 46 are inserted to be exposed to the outside.

Similarly, cap 94 has second connecting member 98 where U-sub-terminal unit 64 of U2-pole bus bar 52, V-sub-terminal unit 74 of V2-pole bus bar 54, and W-sub-terminal unit 84 of W2-pole bus bar 56 are inserted to be exposed to the outside. In this configuration, first connecting member 96 and second connecting member 98 combine connectors (not shown) connected to corresponding sub-devices 10.

Obviously, first connecting member 96 and second connecting member 98 may be formed integrally with cap 94 and the shape is determined for U-sub-terminal units 64 of U1-pole bus bar 42 and U2-pole bus bar 52, V-sub-terminal unit 74 of V1-pole bus bar 44 and V2-pole bus bar 54, and W-sub-terminal unit 84 of W1-pole bus bar 46 and W2-pole bus bar 56, in accordance with the position of cap 94.

Figure 5:
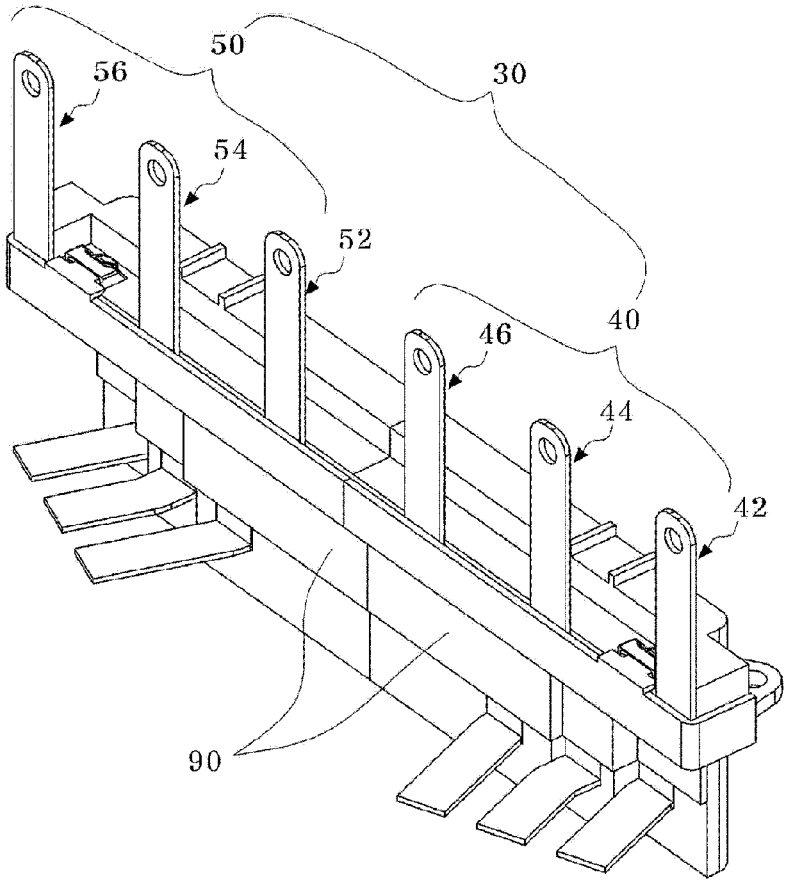
FIG. 5 is a view showing a combination status between a bus bar and a holder of a wire connecting device for a hybrid vehicle according to an exemplary embodiment of the present invention.

U1-pole bus bar 42, V1-pole bus bar 44, and W1-pole bus bar 46 of first unit terminal unit 40 and U2-pole bus bar 52, V2-pole bus bar 54, and W2-pole bus bar 56 of second unit terminal unit 50 may be fixed with the other sides spaced apart from each other, in main device 20. Therefore, as shown in FIG. 5, main device 20 includes a separable holder 90.

Holder 90 fixes the other sides of U1-pole bus bar 42, V1-pole bus bar 44, W1-pole bus bar 46, U2-pole bus bar 52, V2-pole bus bar 54, and W2-pole bus bar 56. In more detail, holder 90 fixes U-main terminal unit 62 of U1-pole bus bar 42 and U2-pole bus bar 52, fixes V-main terminal unit 72 of V1-pole bus bar 44 and V2-pole bus bar 54, and fixes W-main terminal unit 82 of W1-pole bus bar 46 and W2-pole bus bar 56.

Holder 90 may be formed in various shapes, may be an integral single unit, or may be composed of a plurality of separate parts. For convenience and understanding, holder 90 is divided into two parts, and allows the other sides of U1-pole bus bar 42, V1-pole bus bar 44, and W1-pole bus bar 46, and U2-pole bus bar 52, V2-pole bus bar 54, and W2-pole bus bar 56 of second unit terminal unit 50, to be easily mounted.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A wire connecting device for a hybrid vehicle, comprising:

a plurality of bus bars corresponding to a multi-phase for each of a plurality of multi-phase AC sub-devices, wherein the plurality of bus bars are configured to connect sub-devices to a main device, wherein the bus bars for the sub-devices are spaced apart from each other for each of the sub-devices and predetermined ends of the bus bars are bent and spaced apart from each other for each of the sub-devices, wherein the multi-phase AC sub-devices are two 3-phase AC sub-devices and the bus bars are divided into a first unit terminal unit and a second unit terminal unit each composed of a U-pole bus bar, a V-pole bus bar, and a W-pole bus bar, corresponding to the two sub-devices, wherein predetermined ends of the U-pole bus bar, the V-pole bus bar, and the W-pole bus bar of the first unit terminal unit bend to a side, and wherein predetermined ends of the U-pole bus bar, the V-pole bus bar, and the W-pole bus bar of the second unit terminal unit bend to the other side.

2. The wire connecting device as defined in claim 1, wherein predetermined ends of the U-pole bus bar, the V-pole bus bar, and the W-pole bus bar of the first unit terminal unit and predetermined ends of the U-pole bus bar, the V-pole bus bar, and the W-pole bus bar of the second unit terminal unit extend at an angle in the opposite directions to be linearly symmetric.

3. The wire connecting device as defined in claim 1, wherein predetermined ends of the U-pole bus bar, the V-pole bus bar, and the W-pole bus bar of the first unit terminal unit are arranged in parallel with each other.

4. The wire connecting device as defined in claim 2, wherein predetermined ends of the U-pole bus bar, the V-pole bus bar, and the W-pole bus bar of the first unit terminal unit are arranged in parallel with each other.

5. The wire connecting device as defined in claim 1, wherein the same ends of the U-pole bus bar, the V-pole bus bar, and the W-pole bus bar of the second.

6. The wire connecting device as defined in claim 2, wherein the same ends of the U-pole bus bar, the V-pole bus bar, and the W-pole bus bar of the second.

7. The wire connecting device as defined in claim 1, wherein predetermined ends of the U-pole bus bar, the V-pole bus bar, and the W-pole bus bar of the first unit terminal unit bend forward or backward with respect to the axial direction, and predetermined ends of the U-pole bus bar, the V-pole bus bar, and the W-pole bus bar of the second unit terminal unit bend forward or backward with respect to the axial direction.

8. The wire connecting device as defined in claim 2, wherein predetermined ends of the U-pole bus bar, the V-pole bus bar, and the W-pole bus bar of the first unit terminal unit bend forward or backward with respect to the axial direction, and predetermined ends of the U-pole bus bar, the V-pole bus bar, and the W-pole bus bar of the second unit terminal unit bend forward or backward with respect to the axial direction.

9. A wire connecting device, comprising:

a plurality of bus bars configured to connect a plurality of sub-devices to a main device, wherein the bus bars for the sub-devices are spaced apart from each other within each of the sub-devices and predetermined ends of the bus bars are bent and spaced apart from each other within each of the sub-devices, wherein the sub-devices are two 3-phase AC sub-devices and the bus bars are divided into a first unit terminal unit and a second unit terminal unit each composed of a U-pole bus bar, a V-pole bus bar, and a W-pole bus bar, corresponding to the two sub-devices, predetermined ends of the U-pole bus bar, the V-pole bus bar, and the W-pole bus bar of the first unit terminal unit bend to a side, and predetermined ends of the U-pole bus bar, the V-pole bus bar, and the W-pole bus bar of the second unit terminal unit bend to the other side.

10. The wire connecting device as defined in claim 9, wherein predetermined ends of the U-pole bus bar, the V-pole bus bar, and the W-pole bus bar of the first unit terminal unit and predetermined ends of the U-pole bus bar, the V-pole bus bar, and the W-pole bus bar of the second unit terminal unit extend at an angle in the opposite directions to be linearly symmetric.

11. The wire connecting device as defined in claim 9, wherein predetermined ends of the U-pole bus bar, the V-pole bus bar, and the W-pole bus bar of the first unit terminal unit are arranged in parallel with each other.

12. The wire connecting device as defined in claim 10, wherein predetermined ends of the U-pole bus bar, the V-pole bus bar, and the W-pole bus bar of the first unit terminal unit are arranged in parallel with each other.

13. The wire connecting device as defined in claim 9, wherein the same ends of the U-pole bus bar, the V-pole bus bar, and the W-pole bus bar of the second.

14. The wire connecting device as defined in claim 10, wherein the same ends of the U-pole bus bar, the V-pole bus bar, and the W-pole bus bar of the second.

15. The wire connecting device as defined in claim 9, wherein predetermined ends of the U-pole bus bar, the V-pole bus bar, and the W-pole bus bar of the first unit terminal unit bend forward or backward with respect to the axial direction, and predetermined ends of the U-pole bus bar, the V-pole bus bar, and the W-pole bus bar of the second unit terminal unit bend forward or backward with respect to the axial direction.

16. The wire connecting device as defined in claim 10, wherein predetermined ends of the U-pole bus bar, the V-pole bus bar, and the W-pole bus bar of the first unit terminal unit bend forward or backward with respect to the axial direction, and predetermined ends of the U-pole bus bar, the V-pole bus bar, and the W-pole bus bar of the second unit terminal unit bend forward or backward with respect to the axial direction.

17. The wire connecting device as defined in claim 9, wherein the sub-devices are multi-phase AC sub-devices.

* * * * *